US007237869B2

(12) United States Patent
Okamoto

(10) Patent No.: US 7,237,869 B2
(45) Date of Patent: Jul. 3, 2007

(54) INKJET PRINTER

(75) Inventor: Tsugio Okamoto, Kani (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 211 days.

(21) Appl. No.: 10/902,814

(22) Filed: Aug. 2, 2004

(65) Prior Publication Data

US 2005/0057602 A1 Mar. 17, 2005

(30) Foreign Application Priority Data

Aug. 1, 2003 (JP) ..... 2003-285418

(51) Int. Cl.
*B41J 2/165* (2006.01)

(52) U.S. Cl. ..... 347/29; 347/30; 347/32

(58) Field of Classification Search ..... 347/22–35
See application file for complete search history.

(56) References Cited

U.S. PATENT DOCUMENTS

| | | | | |
|---|---|---|---|---|
| 6,578,945 | B2 * | 6/2003 | Hashi et al. | 347/22 |
| 6,672,705 | B2 | 1/2004 | Kitahara et al. | |
| 6,890,056 | B2 * | 5/2005 | Johnson et al. | 347/32 |
| 6,964,468 | B2 | 11/2005 | Kitahara et al. | |
| 2002/0044168 | A1 | 4/2002 | Hashi et al. | |

FOREIGN PATENT DOCUMENTS

| | | | |
|---|---|---|---|
| JP | A 1-221251 | | 9/1989 |
| JP | A-5-330080 | | 12/1993 |
| JP | A-7-186396 | | 7/1995 |
| JP | A-9-085959 | | 3/1997 |
| JP | A-9-123470 | | 5/1997 |
| JP | A 9-187954 | | 7/1997 |
| JP | A 2000-301710 | | 10/2000 |
| JP | 2002-059559 | * | 2/2002 |
| JP | A 2002-59559 | | 2/2002 |
| JP | A 2002-103598 | | 4/2002 |
| JP | A 2003-1855 | | 1/2003 |
| JP | A-2002-120386 | | 4/2003 |
| JP | A-2004-268495 | | 9/2004 |

OTHER PUBLICATIONS

U.S. Appl. No. 10/901,367, filed Jul. 29, 2004, Okamoto et al.
Translation of Japanese Patent Application No. 2004-225842 mailed Aug. 1, 2006.

* cited by examiner

*Primary Examiner*—Shih-Wen Hsieh
(74) *Attorney, Agent, or Firm*—Oliff & Berridge, PLC

(57) ABSTRACT

An inkjet printer includes a conveyance unit, a recording head, a sealing unit, and a carrier unit. The conveyance unit conveys a recording medium in a conveyance direction. The recording head includes plural recording portions. Each recording portion has plural ejection ports for ejecting ink. The recording portions partially overlap each other if viewed in the conveyance direction, when the recording head is located at a recording position where the recording head performs record with respect to the recording medium. The sealing unit is disposed in a region outside the conveyance unit. The sealing unit includes plural sealing portions each of which seals the ejection ports of each recording portion. The sealing portions are arranged in the conveyance direction. The carrier unit carries the recording head in a carrying direction between a sealing position where each sealing portion faces the ejection ports of each recording portion and the recording position.

11 Claims, 5 Drawing Sheets

INKJET PRINTER

BACKGROUND OF THE INVENTION

1. Field of the Invention

The present invention relates to an inkjet printer, and particularly relates to an inkjet printer, which can be miniaturized.

2. Description of the Related Art

An inkjet printer having two line-type recording heads obtained by splitting recording heads into a recording head for black ink and a recording head for color inks is known as disclosed in JP-A-2002-59559. The two recording heads of the inkjet printer are formed to be large enough to extend all over the paper width-direction range, and disposed in parallel in the conveyance direction of the paper. Cap members for reducing evaporation of the inks in the recording heads are disposed in parallel to the recording heads in the conveyance direction of a recording medium. The cap members are formed to be large enough to extend all over the paper width-direction range correspondingly to the dimensions of the recording heads, respectively.

SUMMARY OF THE INVENTION

However, in the inkjet printer having two recording heads one of which is a recording head for black ink and the other of which is a recording head for color inks as described above, a plurality of ejections holes for ejecting ink are formed all over the paper width-direction range in each recording head because the recording head is a line-type recording head. Accordingly, the yield rate in the manufacturing process deteriorates because each recording head has a large number of ejection ports corresponding to the paper width. Thus, there is a problem that the manufacturing cost increases. In addition, long cap members corresponding to the long line-type recording heads have to be installed in a region outside the conveyance path of a recording medium. Thus, there is a problem that the apparatus becomes large in scale.

The invention was developed to solve the foregoing problems and provides an inkjet printer, which can be miniaturized.

In order to solve the foregoing problems, according to one embodiment of the invention, an inkjet printer includes a conveyance unit, a recording unit, a sealing unit, and a carrier unit. The conveyance unit conveys a recording medium in a conveyance direction. The recording head includes a plurality of recording portions. Each of the recording portions has a plurality of ejection ports for ejecting ink. The recording portions partially over lap each other if viewed in the conveyance direction, when the recording head is located at a recording position where the recording head performs record with respect to the recording medium. The sealing unit is disposed in a region outside the conveyance unit and includes a plurality of sealing portions. Each of the sealing unit seals the ejection ports of each recording portion and which are arranged in the conveyance direction. The carrier unit carries the recording head in a carrying direction between a sealing position where each sealing portion faces the ejection ports of each recording portion and the recording position.

With the above-described configuration, the plurality of recording portions cover the recording area of the recording medium. Thus, there is an effect that the yield rate in the manufacturing process is improved so that the manufacturing cost can be reduced in comparison with the case where a single recording portion is produced to be large enough to extend over the recording area of the recording medium.

DETAILED DESCRIPTION OF THE PREFERRED EMBODIMENTS

Figure 1:
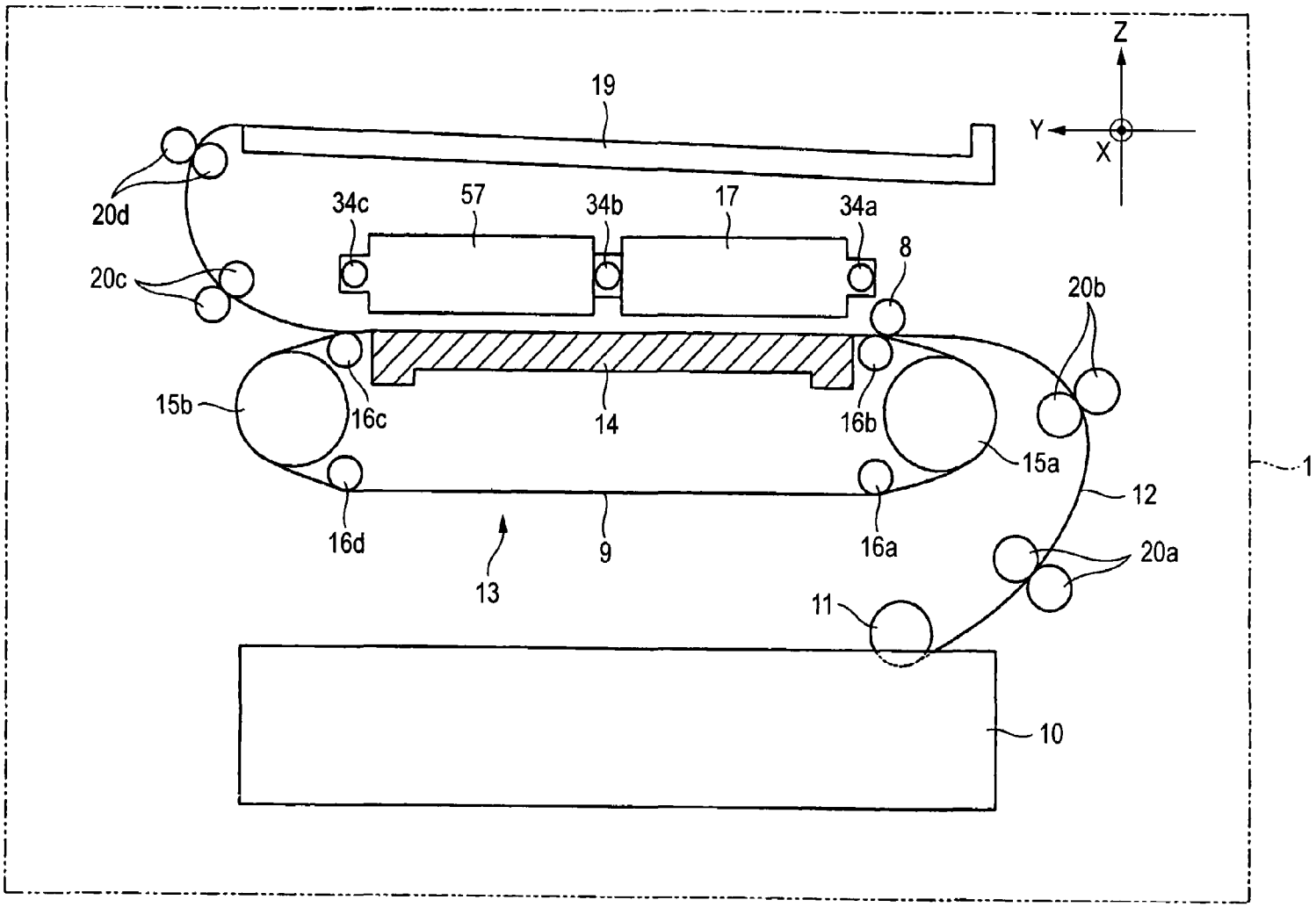
FIG. 1 is a schematic view schematically showing the configuration of an inkjet printer according to an embodiment of the invention.

A preferred embodiment of the invention will be described below with reference to the accompanying drawings. FIG. 1 is a schematic view schematically showing the configuration of an inkjet printer 1 according to an embodiment of the invention. In FIG. 1, the inkjet printer 1 chiefly includes a paper feed cassette 10, a paper feed roller 11, roller portions 20*a*, 20*b*, 20*c* and 20*d*, a conveyance unit 13, a pressure roller 8, two inkjet heads 17 and 57, guide shafts 34*a*, 34*b* and 34*c*, and a paper discharge tray 19. Sheets of paper 12 are stacked in the paper feed cassette 10. The paper feed roller 11 whose surface is formed out of rubber feeds the paper 12 from the paper feed cassette 10 into the conveyance path of the paper 12. The paper 12 fed into the conveyance path by the paper feed roller 11 are fed in the conveyance direction of the paper 12 by the roller portions 20*a*, 20*b*, 20*c* and 20*d*. The conveyance unit 13 conveys the paper 12. The pressure roller 8 presses the paper 12 onto the conveyance unit 13. The inkjet heads 17 and 57 eject various inks onto the paper 12 so as to perform recording (printing). The guide shafts 34*a*, 34*b* and 34*c* function as guides for moving the inkjet heads 17 and 57 forward and backward in the width direction of the paper 12, that is, X direction in FIG. 1. The paper 12 on which desired printing has been performed by the inkjet heads 17 and 57 is discharged to the paper discharge tray 19.

The inks to be ejected from the inkjet heads 17 and 57 include four color inks of cyan, magenta, yellow and black. A cyan ink cartridge 4C, a magenta ink cartridge 4M, a yellow ink cartridge 4Y and a black ink cartridge 4K filled with the color inks respectively are disposed under a capping unit 30 (see FIG. 3), which will be described later.

Figure 2:
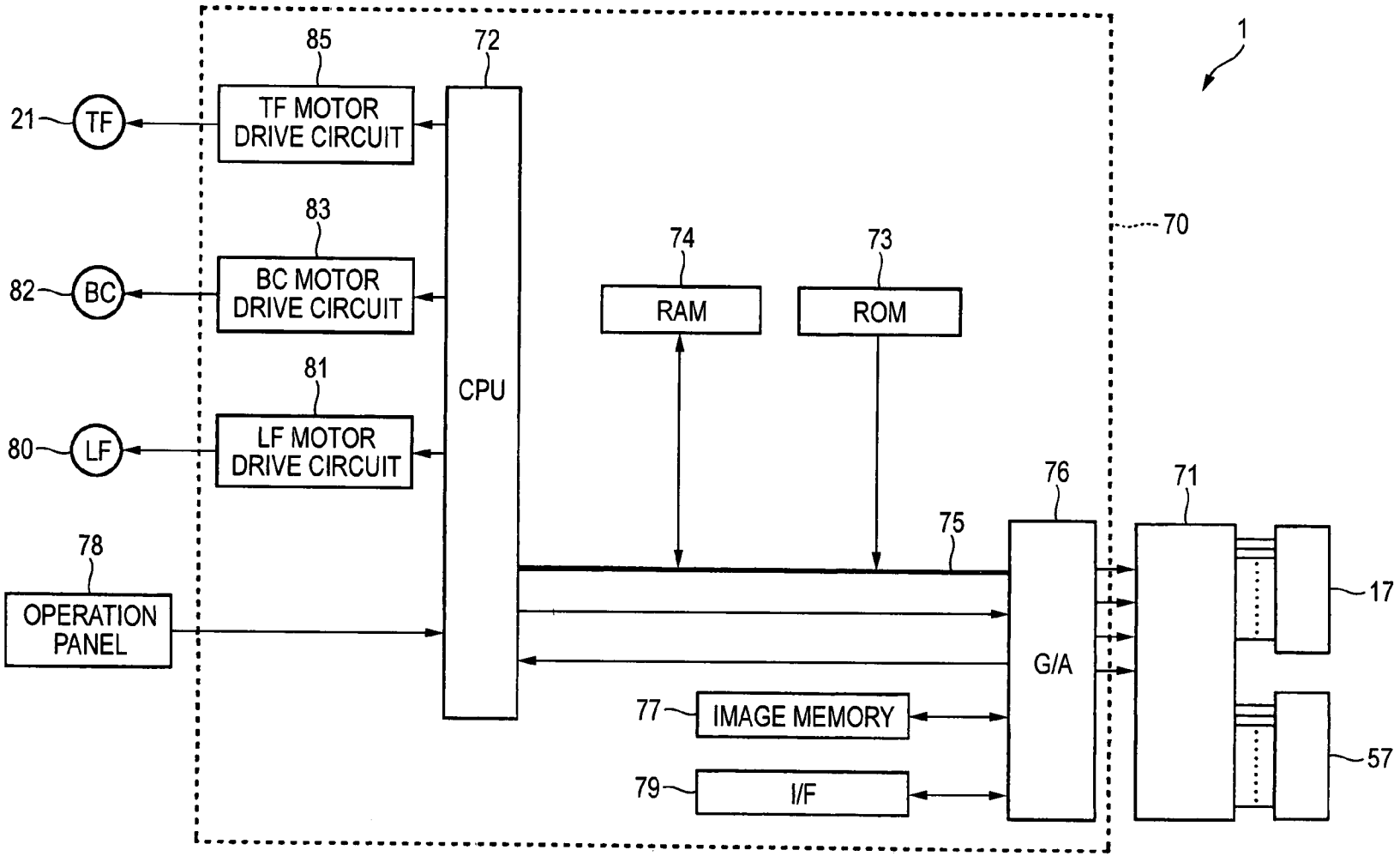
FIG. 2 is a block diagram showing the outline of the electric circuit configuration of the inkjet printer.
Figure 3:
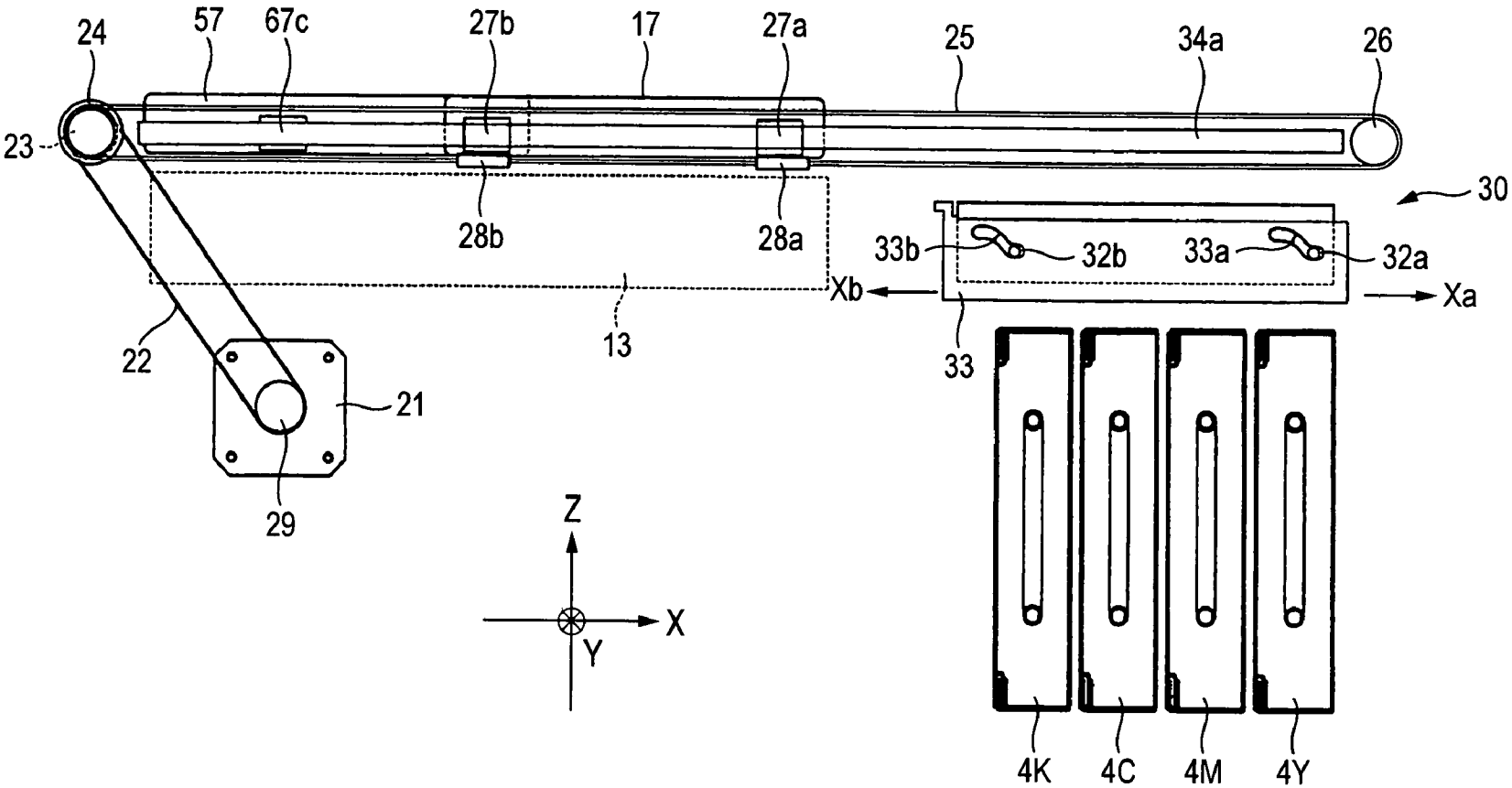
FIG. 3 is a side view taken from Y direction in FIG. 1, showing the configuration of inkjet heads and a capping unit.

In addition, a TF motor 21 (see FIG. 2) functioning as a driving source for moving the inkjet heads 17 and 57 forward and backward in the width direction of the paper 12 (X direction) is disposed between the paper feed cassette 10 and the conveyance unit 13 (see FIG. 3).

The conveyance unit 13 has a belt 9, two conveyance rollers 15*a* and 15*b*, a support member 14, and four additional rollers 16*a*, 16*b*, 16*c* and 16*d*. The belt 9 is formed out of a material having flexibility without stretch ability, and the outer surface thereof has adhesiveness. The conveyance rollers 15*a* and 15*b* are driven by an LF motor 80 (see FIG. 2) while retaining the belt 9 at its both ends. The support member 14 supports the belt 9 from below when the belt 9 passes through a printing area where the inks are ejected from the inkjet heads 17 and 57 to thereby perform desired printing. The additional rollers 16*a*, 16*b*, 16*c* and 16*d* gives tension to the bent 9 from the inside of the belt 9.

A BC motor 82 (see FIG. 2) can drive the support member 14 and the additional rollers 16*a*–16*d* integrally in the up/down direction (that is, Z direction) so as to vary the position of the belt 9 in the up/down direction (Z direction in FIG. 1). Driving the support member 14 and the additional rollers 16*a*–16*d* in the up/down direction is performed so that they move down when the TF motor 21 reciprocates the inkjet heads 17 and 57 are reciprocated, and they move up when the inkjet heads 17 and 57 are disposed at a predetermined recording position. Incidentally, there is formed a gap of about "1 mm" between each inkjet head 17, 57 and the belt 9. Accordingly, it is also possible to reciprocate the inkjet heads 17 and 57 without operating the support member 14 and the additional rollers 16*a*–16*d* in the up/down direction. Instead, the support member 14 may swing around the conveyance roller 15*b* as a shaft.

Here, description will be made on a series of operations till the paper 12 fed from the paper feed cassette 10 is discharged to the paper discharge tray 19.

The paper feed cassette 10 includes a paper support plate, a compression spring and a paper presser foot. The paper support plate supports, from below, sheets of paper 12 stacked in the paper feed cassette 10. The compression spring urges the paper support plate upward. The paper presser foot presses the stacked sheets of paper 12 from above so as to prevent the uppermost sheet of paper 12 from slipping away accidentally. The uppermost sheet of paper 12 abuts against the paper feed roller 11 due to the paper support plate, the compression spring and the paper presser foot.

When the paper feed roller 11 is rotated by a not-shown driving source, the paper 12 is fed out to the conveyance path by the paper feed roller 11. The paper 12 fed out by the paper feed roller 11 is sent to the roller portion 20*a*. The paper 12 put between a pinch roller and a paper feed rubber roller of the roller portion 20*a* is sent to the roller portion 20*b*. The roller portion 20*b* has the same configuration as the roller portion 20*a*. The paper 12 put between a pinch roller and a paper feed rubber roller of the roller portion 20*b* is fed toward the inkjet heads 17 and 57.

The paper 12 fed through the roller portions 20*a* and 20*b* is pressed by the pressure roller 8 immediately before the conveyance unit 13 so as to adhere to the belt 9. Thus, the paper 12 is prevented from slipping in the printing area. While the paper 12 adhering to the belt 9 passes between the inkjet heads 17 and 57 and the belt 9, inks are ejected from the inkjet heads 17 and 57 so as to perform desired printing.

The paper 12 on which desired printing has been performed by the inkjet heads 17 and 57 is finally discharged to the paper discharge tray 19 through the roller portions 20*c* and 20*d* configured in the same manner as the roller portion 20*a*. Incidentally, although the embodiment has been described on the case where the four roller portions 20*a*–20*d* are provided in the conveyance path of the paper 12, not-shown plural roller portions may be provided in addition to the roller portions 20*a*–20*d*. In addition, of the plural roller portions provided in the conveyance path, at least one maybe driven by a not-shown driving source so as to convey the paper 12.

FIG. 2 is a block diagram showing the outline of the electric circuit configuration of the inkjet printer 1. A control unit for controlling the inkjet printer 1 includes a main control board 70, and a sub-control board 71 for controlling the inkjet heads 17 and 57. The main control board 70 is mounted with a microcomputer (CPU) 72, a ROM 73, a RAM 74, an image memory 77 and a gate array (G/A) 76. The CPU 72 has a one-chip configuration. The ROM 73 is a read-only memory for storing fixed-value data including various control programs to be executed by the CPU 72, judgment tables and the like. The RAM 74 is a rewritable memory for temporarily storing various data and the like.

The CPU 72 functioning as an arithmetic unit executes various processes in accordance with the control programs stored in ROM 73 in advance. In addition, the CPU 72 generates a printing timing signal and a reset signal, and transfers the signals to the G/A 76, which will be described later. An operation panel 78, a head carriage motor (TF motor) drive circuit 85, a belt up/down motor (BC motor) drive circuit 83, a conveyance motor (LF motor) drive circuit 81, etc. are connected to the CPU 72. A user gives instructions for printing and the like through the operation panel 78. The TF motor drive circuit 85 drives the TF motor 21 for reciprocating the inkjet heads 17 and 57 in the width direction of the paper 12 (X direction) The BC motor drive circuit 83 drives a BC motor 82 for operating the support member 14 and the additional rollers 16*a*–16*d* in the up/down direction (Z direction) so as to change the height of the belt 9. The LF motor drive circuit 81 operates the LF motor 80 for rotating the conveyance rollers 15*a* and 15*b* to thereby drive and rotate the belt 9 so as to convey the paper 12. The CPU 72 controls the operation of each device connected thus.

The G/A 76 outputs print data (driving signal), a transfer clock, a latch signal, a parameter signal and an ejection timing signal in accordance with the printing timing signal transferred from the CPU 72 and image data stored in the image memory 77. The image data is printed on the recording medium based on the print data. The transfer clock is synchronized with the print data. A reference printing waveform signal is generated from the parameter signal. The ejection timing signal is outputted in a constant period. The G/A 76 transfers those signals to the sub-control board 71 mounted with a head driver.

In addition, the G/A 76 stores image data into the image memory 77. The image data is transferred from external equipment such as a computer through an interface (I/F) 79. The G/A 76 generates a data reception interrupt signal based on data transferred from a host computer or the like through the I/F 79, and transfers the signal to the CPU 72. The ROM 73, the RAM 74 and the G/A 76 are connected to the CPU 72 through a bus line 75.

The sub-control board 71 is a board for driving the inkjet heads 17 and 57 by a head driver (drive circuit) mounted on the sub-control board 71. The head driver is controlled through the G/A 76 mounted on the main control board 70, so as to apply a drive pulse of waveform corresponding to a recording mode to each drive element of the recording heads. Thus, a predetermined amount of ink is ejected.

Figure 4:
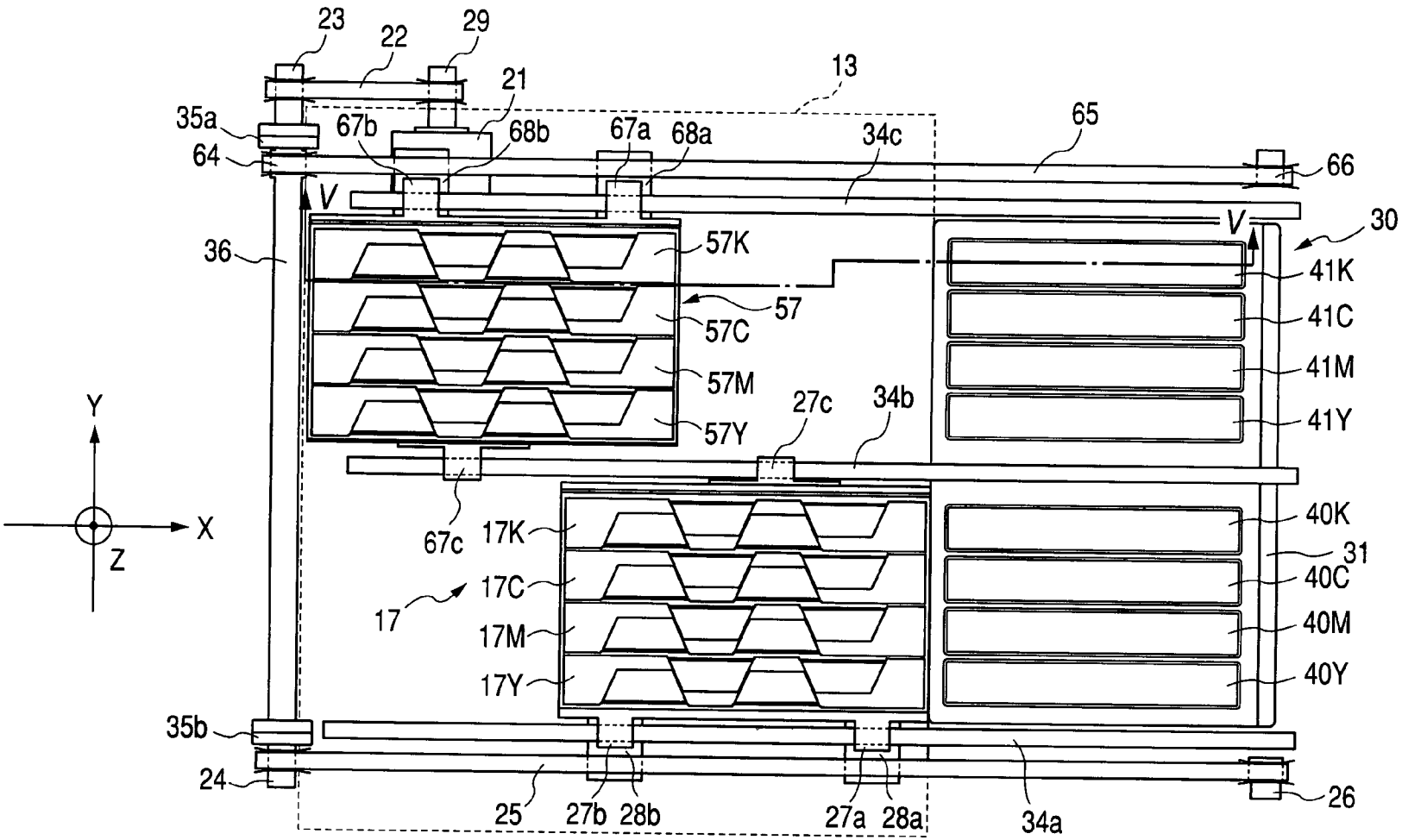
FIG. 4 is a top view taken from Z direction in FIG. 1, showing the configuration of the inkjet heads and the capping unit located in a recording position.

Next, with reference to FIGS. 3 to 5, description will be made on the configuration of the inkjet heads 17 and 57 and the capping unit 30, and the configuration in which the inkjet heads 17 and 57 reciprocate between the recording position and the capping unit 30. FIG. 3 is a side view taken from the Y direction in FIG. 1, showing the configuration of the inkjet heads 17 and 57 and the capping unit 30. FIG. 4 is a top view taken from the Z direction in FIG. 1, showing the configuration of the inkjet heads 17 and 57 and the capping unit 30 positioned at the recording position. FIG. 5 is a section view of the capping unit 30, taken along line V—V in FIG. 4.

The inkjet head 17 has a head for each color. That is, the inkjet head 17 is constituted by a yellow head 17Y for ejecting yellow ink, a magenta head 17M for ejecting magenta ink, a cyan head 17C for ejecting cyan ink, and a black head 17K for ejecting black ink. Each of these heads is connected to an ink cartridge corresponding to the ink of the head through a tube. When the ink is ejected from the head so that the ink decreases, an amount of ink corresponding to the decrease of the ink is charged from the ink cartridge through the tube.

Each head is a line-type head. Four actuator units each having a substantially trapezoidal shape in view taken from the Z direction are provided in the head. The actuator units are disposed so that their end portions overlap each other in a direction in which the short sides of the trapezoids are opposed to each other and in the conveyance direction (the Y-direction in FIG. 4) of the paper 12. In the ejection area of the head, a plurality of ejection ports for ejecting ink therefrom are arrayed in the form of a 16-column matrix. Accordingly, printing can be performed without any gap between adjacent ones of the actuator units. In this embodiment, 664 ejection ports are formed all over one ejection area. Incidentally, the inkjet head 57 has the same configuration as the inkjet head 17, and description thereof will be omitted.

To perform desired printing on the paper 12, the inkjet heads 17 and 57 are disposed so that their one end portions overlap each other in the conveyance direction of the paper 12 (the Y direction) as shown in FIG. 4. This configuration is adopted to perform printing without any gap between the inkjet heads 17 and 57. In other words, the actuator units provided on the one end portions of the inkjet heads 17 and 57 overlap each other when viewed in a direction in which the short sides of the trapezoids of the actuator units are opposed to each other.

The capping unit 30 is used to seal the ejection surfaces of the inkjet heads 17 and 57 having ejection ports formed therein when the inkjet heads 17 and 57 are not in use. Thus, a failure in ejection due to evaporation of ink droplets inside the ejection ports is prevented from occurring, so that the inkjet heads 17 and 57 can be kept in good condition. The capping unit. 30 is disposed adjacently to the conveyance unit 13 in the width direction of the paper 12 (that is, the X direction), and has dimensions corresponding to the inkjet heads 17 and 57. On the top of the capping unit 30, cap portions 40Y, 40M, 40C and 40K for sealing the ejection surfaces are disposed correspondingly to the heads of the inkjet head 17 respectively, and cap portions 41Y, 41M, 41C and 41K for sealing the ejection surfaces are disposed correspondingly to the heads of the inkjet head 57 respectively.

Incidentally, as shown in FIG. 4, the eight cap portions 40Y–40K and 41Y–41K are integrated in parallel in the conveyance direction of the paper 12 (that is, the Y direction) so as to form a cap body 31 (see FIG. 3).

Figure 5A:
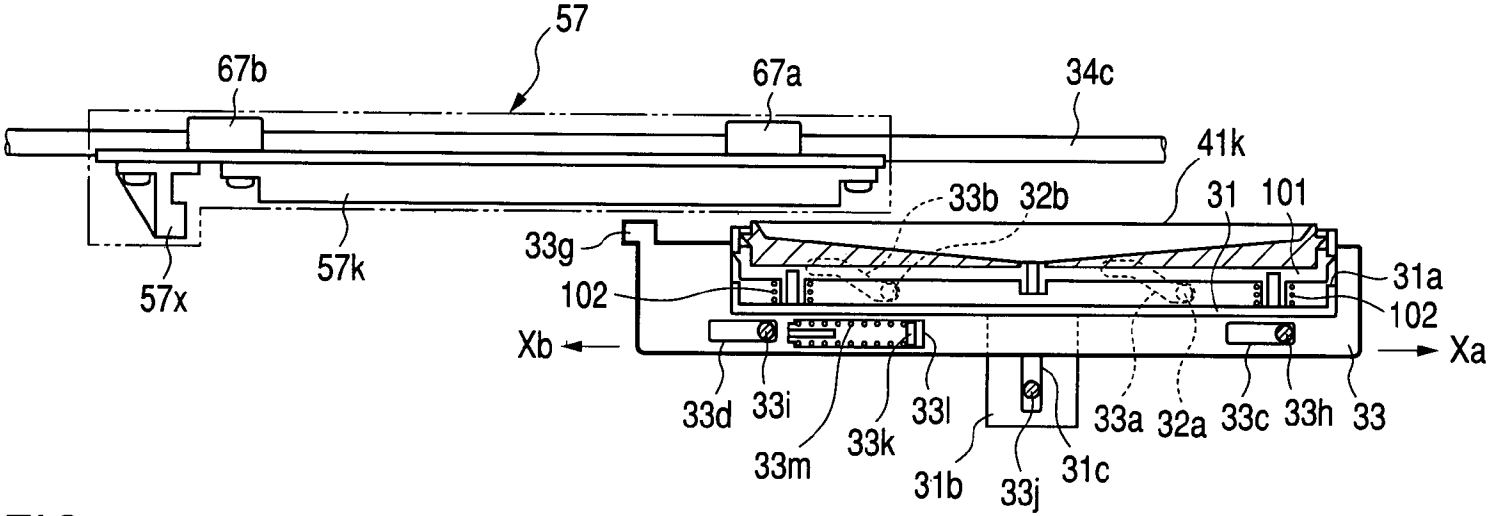
FIG. 5 is a section view of the capping unit, taken along line V—V in FIG. 4.
Figure 5B:
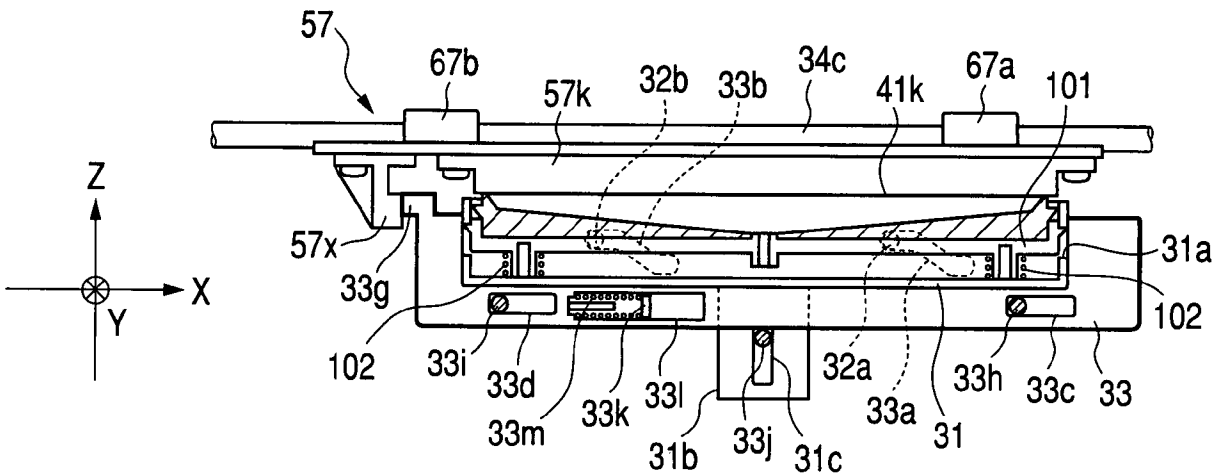

FIG. 5A shows a state where the capping unit 30 is separate from the inkjet head 57. FIG. 5B shows a state where the capping unit 30 seals the inkjet head 57. Each of the capping unit 30 includes the cap body 31, a movable member 33, a cap holder 101, and the cap portions 41Y–41K (40Y–40K). Springs 102 are disposed between the cap body 31 and the cap holder 101 and urge the cap holder 101 upwardly. The cap portions 40Y–40K and 41Y–41K are disposed on the upper surfaces of the cap holders 101, respectively. The movable member 33 has a cam surface extending in the X direction. It is noted that the movable member 33 (the cam surface) is disposed on the +Y-direction side with respect to the cap portion 41K in FIG. 4 and that the movable member 33 (not shown) is also disposed on the −Y-direction side with respect to the cap portion 40Y. The cam surface of the movable member 33 defines holes 33*a*, 33*b* and holes 33*c*, 33*d*, 33*l*, which elongate in the X direction horizontally. As shown in FIG. 5, the holes 33*a* and 33*b* have the highest portions in the Z direction on the Xb-direction side while being lower gradually as the position goes in the arrow Xa direction. Shafts 33*h*, 33*i*, 33*k* fixed to a frame (not-shown) of the inkjet printer 1 are inserted into the holes 33*c*, 33*d*, 33*l*, respectively. In other words, the shafts 33*h*, 33*i*, 33*k* support the movable member 33. Spring 33*m* is disposed between the shaft 33*k* and the movable member 33 and urges the movable member 33 in the Xb direction. As shown in FIG. 5A, when the inkjet heads 17, 57 are separate from the capping units 30, since the spring 33*m* urges the movable member 33 in the left direction (Xb direction), the shafts 33*h*, 33*i*, 33*k* are located at the rightmost position in the holes 33*c*, 33*d*, 33*l*. One of the X-direction side surfaces of the movable member 33 on the Xb-direction side includes a pushed portion 33*g*, which protrudes therefrom in the Xb direction. The cap body 31 has two Y-direction side surfaces and two X-direction side surfaces, which rise from a bottom surface thereof. Shafts 32*a*, 32*b* protrude from each of the Y-direction side surface of the cap body 31 in the Y direction and are inserted into the holes 33*a*, 33*b* of the movable member 33, respectively. The cap body 31 also includes a protrusion piece 31*b* that protrudes from the Y-direction side surface of the cap body 31 downwardly and defines a hole 31*c*. A shaft 33*j* fixed to the frame of the inkjet printer 1 is inserted into the hole 31*c*. The cap holder 101 is supported by the cap body 31 through notches 31*a*. Since the notches 31*a* elongate in the vertical direction (Z direction), the cap holder 101 is movable in the Z direction while being urged by the spring 102. With this configuration, the movable member 33 can reciprocate in the carriage direction of the inkjet heads 17 and 57 (directions of the arrows Xa and Xb in FIG. 3).

As shown in FIG. 5, the inkjet heads 17, 57 include a pushing portions 17*x*, 57*x* at end portions thereof in the Xb direction. The pushing portions 17*x*, 57*x* have an L-like shape and protrude in the Xa direction as shown in FIG. 5.

As shown in FIG. 4, the TF motor 21 is disposed under the conveyance unit 13 and above the paper feed cassette 10. A rotating shaft 29 of the TF motor 21 and a drive shaft 23 for reciprocating the inkjet heads 17 and 57 are linked through the belt 22. The driving force of the TF motor 21 is transmitted to the drive shaft 23 through the belt 22. The drive shaft 23 is linked with a first clutch 35*a*. The first clutch 35*a* is linked with a first belt 65 designed to be rotatable by pulleys 64 and 66, and also linked with the rotating shaft 36 for transmitting the driving force to a second clutch 35*b*. The first clutch 35*a* can change over mechanically as to whether to transmit the driving force to the first belt 65 and the rotating shaft 36 or not.

The second clutch 35*b* is linked with a second belt 25 designed to be rotatable by pulleys 24 and 26. The second clutch 35*b* can change over mechanically as to whether to transmit the second belt 25 the driving force transmitted to the rotating shaft 36 to or not.

The inkjet head 17 is fixed to the second belt 25 through two belt fixing members 28*a* and 28*b*. The inkjet head 17 is attached to the guide shaft 34*a* through two guide members 27*a* and 27*b* so that the guide shaft 34*a* guides the inkjet head 17, and also attached to the guide shaft 34*b* through a guide member 27*c* so that the guide shaft 34*b* guides the inkjet head 17. Thus, when the second belt 25 is driven, the inkjet head 17 is reciprocated in the width direction of the paper 12 (that is, the X direction) while being guided by the guide shafts 34*a* and 34*b*.

The inkjet head 57 is fixed to the first belt 65 through two belt fixing members 68*a* and 68*b*. The inkjet head 57 is attached to the guide shaft 34*c* through two guide members 67*a* and 67*b* so that the guide shaft 34*c* guides the inkjet head 57, and also attached to the guide shaft 34*b* through a guide member 67*c* so that the guide shaft 34*b* guides the inkjet head 57. Thus, when the first belt 65 is driven, the inkjet head 57 is reciprocated in the width direction of the paper 12 (that is, the X direction) while being guided by the guide shafts 34*b* and 34*c*.

When the ejection ports of the inkjet heads 17 and 57 are to be sealed with the capping unit 30, the first clutch 35*a* is changed over to be able to transmit the driving force, while the second clutch 35*b* is changed over not to transmit the driving force. Then, the TF motor 21 is driven. Incidentally, before the TF motor 21 is driven, the support member 14 and the additional rollers 16*a*–16*d* are moved down to surely prevent interference from occurring between the inkjet heads 17 and 57 and the belt 9, as described above.

Next, description will be made on the operation for sealing the heads 17 and 57. When the TF motor 21 is driven with the heads 17 and 57 being located in the recording position shown in FIG. 4, the inkjet head 57 begins to be carried toward the capping unit 30 (in the arrow Xa direction in FIG. 3). When the inkjet head 57 reaches a position where the inkjet head 57 is aligned with the inkjet head 17 in the conveyance direction of the paper 12 (that is, the Y direction), the second clutch 35*b* is changed over to be able to transmit the driving force so as to carry the inkjet heads 17 and 57 integrally toward the capping unit 30.

The inkjet heads 17 and 57 are carried toward the capping unit 30, and the pushing portion 57*x* of the inkjet head 57 abuts against the pushed portion 33*g* of the movable member 33. When the pushing portion 57*x* of the inkjet head 57 further pushes the pushed portion 33*g* of the movable member 33 so that the movable member 33 moves in the arrow Xa direction against the urging force of the spring 33*m*, the holes 33*a* and 33*b* of the movable member 33 press upward the shafts 32*a* and 32*b* projecting from the Y-direction side surface of the cap body 31. The shafts 32*a* and 32*b* are guided by the holes 33*a*, 33*b* so as to move upward gradually. When the shafts 32*a*, 32*b* are moved upward together with the cap body 31, the cap holder 101 is move upward. As a result, the cap portions 40Y–40K and 41Y–41K move upward to seal the ink ejection surface of the inkjet head 17, 57.

On the other hand, when recording is resumed, the inkjet heads 17 and 57 are moved in the arrow xb direction so as to return to the recording position. When the pressing portions 17*x*, 57*x* of the inkjet heads 17, 57 detach from the pressed portion 33*g* of the movable member 33, the movable member 33 also moves in the arrow Xb direction due to the urging force of the spring 33*m*, so that the holes 33*a* and 33*b* of the movable member 33 presses downward the shafts 32*a* and 32*b* of the cap body 31. The shafts 32*a* and 32*b* are guided by the holes 33*a* and 33*b* so as to move downward gradually. Then, the cap body 31 moves downward to retract. As a result, the cap portions 40Y–40K and 41Y–41K detach from the ink ejection surfaces of the inkjet heads 17, 57.

The inkjet heads 17 and 57 are carried to the recording position as follows. That is, at the timing when the inkjet head 17 has been carried to the recording position, the second clutch 35*b* is changed over not to transmit the driving force. Then, the carriage of the inkjet head 17 is completed. At the timing when the inkjet head 57 has been carried to the recording position, the first clutch 35*a* is changed over not to transmit the driving force. After that, driving the TF motor 21 is stopped. Then, the carriage of the inkjet head 57 is completed. When the inkjet heads 17 and 57 are disposed at the recording position, the support member 14 and the additional rollers 16*a*–16*d* are lifted up.

Accordingly, the recording heads 17 and 57 can be carried independently of each other between a sealing position where the cap unit 30 seals the recording heads 17 and 57 and a recording position where the recording heads 17 and 57 eject ink onto the paper 12. Therefore, the positional relationship among the recording heads 17 and 57 when they are located at the recording position, can be changed from that when they are located at the sealing position. The positional relationship among the recording heads 17 and 57 at the sealing position can be set suitably independently of that at the recording position, so that the inkjet printer 1 can be miniaturized and aggregated in comparison with that in the background art.

In addition, a single motor (TF motor 21) generates drive power and can transmit the drive power to the recording heads 17 and 57 independently. Therefore, this embodiment does not need a plurality of TF motors 21. As a result, the manufacturing cost of the inkjet printer 1 can be reduced.

In addition, this embodiment does no need a drive source for moving the cap unit 30 toward the recording heads 17 and 57 after the recording heads 17 and 57 are carried a position where the recording heads 17 and 57 face the cap unit 30. Thus, the manufacturing cost can also be reduced.

As described above, the inkjet printer 1 has the line-type inkjet heads 17 and 57 separated in the width direction of the paper 12 (the X direction) and disposed so that portions thereof overlap each other in the conveyance direction of the paper 12 (the Y direction). Accordingly, in comparison with the case where one inkjet head is produced to be large enough to extend all over the width-direction range of the paper 12, the yield rate in the manufacturing process can be improved so that the manufacturing cost can be reduced.

In addition, the capping unit 30 is disposed adjacently to the conveyance unit 13, and the cap portions disposed on the top of the capping unit 30 are arrayed in parallel in the conveyance direction of the paper 12. Accordingly, the inkjet heads 17 and 57 separated in the width direction of the paper 12 (the X direction) and disposed so that portions thereof overlap each other in the conveyance direction of the paper 12 (the Y direction) can be disposed in parallel above the capping unit 30. As a result, the inkjet printer 1 can be prevented from increasing in size in the conveyance direction of the paper 12 (the Y direction), and prevented from increasing in size in the width direction of the paper 12 (the X direction). It is therefore possible to prevent the apparatus from increasing in size.

Although the invention has been described above based on its embodiment, the invention is not limited to the aforementioned embodiment at all. It can be imagined easily that various improvements and modifications can be made without departing from the gist of the invention.

For example, although the embodiment has been described on the case where the first clutch 35*a* is provided so as to be changed over whether to transmit the driving force to the first belt 65 and the rotating shaft 36 or not, the rotating shaft 23 may be linked to the first belt 65 and the rotating shaft 36 without providing the first clutch 35*a*. In this case, driving the first belt 65 can be controlled by the rotation and stop of the TF motor 21, and driving the second belt 25 can be controlled by changing over the second clutch 35*b*. Thus, the number of parts can be reduced so that the manufacturing cost can be reduced.

Although the embodiment has been described on the case where the two inkjet heads 17 and 57 are sealed simultaneously when the ejection surfaces of the inkjet heads 17 and 57 are sealed with the capping unit 30, one of the inkjet heads not to be used may be sealed with the capping unit 30. For example, when the size of the paper 12 is so small that printing can be performed by only the inkjet head 17, only the inkjet head 57 may be sealed with the capping unit 30 in order to prevent evaporation from the ejection ports of the inkjet head 57. In this case, when two guide shafts serving as the guide shaft 34*b* are provided for the inkjet head 17 and for the inkjet head 57 respectively, the inkjet head 57 alone can be carried. Alternatively, when the size of the paper 12 is so small the printing can be performed by only the inkjet head 57, only the inkjet head 17 may be sealed with the capping unit 30. With this alternative configuration, there is no need to provide two guide shafts 34*b*.

Although the embodiment has been described on the case where the inkjet head is separated into the two inkjet heads 17 and 57, the inkjet head may be separated into three or more plural inkjet heads. On this occasion, the separated heads are disposed so that each of the separated heads located on the both sides in the width direction of the paper (the X direction) overlaps another separated head adjacent thereto in one end portion thereof, while the other separated heads that are not located on the both sides over lap two other separated heads adjacent thereto on the both end portions thereof.

What is claimed is:

1. An inkjet printer comprising:

a conveyance unit that conveys a recording medium in a conveyance direction;

a plurality of recording heads, each recording head includes a plurality of recording portions each of which has a plurality of ejection ports for ejecting ink, adjacent recording portions of the plurality of recording portions partially overlap each other if viewed in the conveyance direction, when the plurality of recording heads are located at a recording position where the plurality of recording heads perform record with respect to the recording medium;

a sealing unit that is disposed in a region outside the conveyance unit and includes a plurality of sealing portions, each of which seals the ejection ports of each recording portion and which are arranged in the conveyance direction; and a carrier unit that carries each of the plurality of recording heads independently in a carrying direction between a sealing position where each sealing portion faces the ejection ports of each recording portion and the recording position, wherein when the plurality of recording heads perform record with respect to the recording medium, end portions of the plurality of recording portions of the plurality of recording heads overlap each other if viewed in the conveyance direction.

2. The inkjet printer according to claim 1, wherein the plurality of recording portions are arranged in the conveyance direction.

3. The inkjet printer according to claim 1, wherein the carrier unit carries the plurality of recording portions of the each of the plurality of recording heads between corresponding sealing position and the recording position independently of each other.

4. The inkjet printer according to claim 3, wherein the carrier unit includes:

a drive source that generates drive power for carrying the recording portions of the each of the recording heads; and a setting unit that sets which of the recording portions the drive power is transmitted to.

5. The inkjet printer according to claim 3, wherein:

the recording portions include first to nth recording portions;

the carrier unit includes:

a drive source that generates drive power for carrying the recording portions of the each of the plurality recording heads; and first to nth clutches;

the drive source transmits the drive power to the first clutch;

the ith clutch changes over whether the ith clutch transmits the drive power to the (i+1)th clutch and the ith recording portion, where $1 \leqq i \leqq n-1$; and the nth clutch changes over whether the nth clutch transmits the drive power to the nth recording portion.

6. The inkjet printer according to claim 3, wherein:

the recording portions include first to nth recording portions;

the carrier unit includes:

a drive source that generates drive power for carrying the recording portions of the each of the plurality recording heads; and first to (n−1)th clutches;

the drive source transmits the drive power to the first recording portion and the first clutch;

the ith clutch changes over whether the ith clutch transmits the drive power to the (i+1) th clutch and the (i+1) th recording portion, where $1 \leqq i \leqq n-2$; and the (n−1) th clutch changes over whether the (n−1) th clutch transmits the drive power to the nth recording portion.

7. The inkjet printer according to claim 1, wherein:

the sealing unit includes a contact portion that contacts with at least a part of at least one of the plurality of recording heads when the carrier unit carries the at least one of the plurality of recording heads to the sealing position; and when the at least part of the at least one of the plurality of recording heads recording contacts with and presses the contact portion in the carrying direction, the plurality of sealing portions approaches the plurality of the recording portions to seal the ejection ports of the plurality of the recording portions, respectively.

8. The inkjet printer according to claim 1, wherein each of the recording portions includes four recording parts that eject black ink, cyan ink, magenta ink, and yellow ink, respectively.

9. The inkjet printer according to claim 1, further comprising a movement mechanism that moves the conveyance unit so that the conveyance unit is apart from the recording head.

10. The inkjet printer according to claim 1, wherein the conveyance direction is perpendicular to the carrying direction.

11. An inkjet printer comprising:

conveyance means for conveying a recording medium in a conveyance direction;

a plurality of recording heads, each recording head includes a plurality of recording portions each of which has a plurality of ejection ports for ejecting ink, adjacent recording portions of the plurality of recording portions partially overlap each other if viewed in the conveyance direction, when the plurality of recording heads are located at a recording position where the plurality of recording heads perform record with respect to the recording medium;

a sealing unit that is disposed in a region outside the conveyance means and includes a plurality of sealing means, each for sealing the ejection ports of each recording portion and which are arranged in the conveyance direction; and carrier means for carrying each of the plurality of recording heads in a carrying direction between a sealing position, where each sealing means faces the ejection ports of each recording portion and the recording position, wherein when the plurality of recording heads perform record with respect to the recording medium, end portions of the plurality of recording portions of the plurality of recording heads overlap each other if viewed in the conveyance direction.

* * * * *